US010333214B2

(12) United States Patent
Kushta

(10) Patent No.: US 10,333,214 B2
(45) Date of Patent: Jun. 25, 2019

(54) ANTENNA RADIATING ELEMENTS AND SPARSE ARRAY ANTENNAS AND METHOD FOR PRODUCING AN ANTENNA RADIATING ELEMENT

(71) Applicant: NEC Corporation, Minato-ku, Tokyo (JP)

(72) Inventor: Taras Kushta, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/558,742

(22) PCT Filed: Mar. 19, 2015

(86) PCT No.: PCT/JP2015/059279
§ 371 (c)(1),
(2) Date: Sep. 15, 2017

(87) PCT Pub. No.: WO2016/147421
PCT Pub. Date: Sep. 22, 2016

(65) Prior Publication Data

US 2018/0083354 A1 Mar. 22, 2018

Related U.S. Application Data

(63) Continuation of application No. PCT/JP2015/059279, filed on Mar. 19, 2015.

(51) Int. Cl.
*H01Q 1/38* (2006.01)
*H01Q 1/48* (2006.01)
(Continued)

(52) U.S. Cl.
CPC ..... *H01Q 1/523* (2013.01); *H01Q 1/38* (2013.01); *H01Q 1/48* (2013.01); *H01Q 9/045* (2013.01);
(Continued)

(58) Field of Classification Search
CPC ..... H01Q 1/523; H01Q 1/38; H01Q 1/48; H01Q 9/0421; H01Q 9/045; H01Q 21/0025; H01Q 21/0087; H01Q 21/065
(Continued)

(56) References Cited

U.S. PATENT DOCUMENTS

2012/0242547 A1* 9/2012 Fujii ..... H01Q 1/38 343/700 MS
2012/0325523 A1 12/2012 Kobayashi et al.
(Continued)

FOREIGN PATENT DOCUMENTS

| | | | |
|---|---|---|---|
| JP | H06-020870 | A | 1/1994 |
| WO | 2011/010393 | A1 | 1/2011 |
| WO | 2011/111297 | A1 | 9/2011 |

OTHER PUBLICATIONS

Taras Kushta, "Vertical Transmission Lines in Multilayer Substrates and Highly-Integrated Filtering Components Based on These Transmission Lines", Passive Microwave Components and Antennas, Vitaliy Zhurbenko, Apr. 1, 2010, chapter 13, pp. 267-302.
(Continued)

*Primary Examiner* — Lam T Mai

(57) ABSTRACT

It is an object of the present invention to provide compact and wideband array antennas based on multilayer substrate technologies which can be applied in lightweight radars. An antenna radiating element disposed in a multilayer substrate comprises a signal via; a plurality of ground vias surrounding the signal via; a radiation pad connected to one end of the signal via; a feed pad connected to another end of the signal vias; and an artificial medium disposed between the signal via and the ground vias; wherein the multilayer substrate comprises a plurality of conductor layers isolated by a dielectric material.

9 Claims, 36 Drawing Sheets

(51) Int. Cl.

| | |
|---|---|
| ***H01Q 1/52*** | (2006.01) |
| ***H01Q 9/04*** | (2006.01) |
| ***H01Q 21/06*** | (2006.01) |
| ***H01Q 21/00*** | (2006.01) |
| *H01Q 15/00* | (2006.01) |

(52) U.S. Cl.
CPC ..... *H01Q 9/0421* (2013.01); *H01Q 21/0025* (2013.01); *H01Q 21/0087* (2013.01); *H01Q 21/065* (2013.01); *H01Q 15/0086* (2013.01)

(58) Field of Classification Search
USPC ..... 343/880, 700 MS, 702
See application file for complete search history.

(56) References Cited

U.S. PATENT DOCUMENTS

2018/0123222 A1* 5/2018 Jang ..... H01Q 1/1214
2018/0145420 A1* 5/2018 Kushta ..... H01O 15/0026

OTHER PUBLICATIONS

International Search Report for PCT Application No. PCT/JP2015/059279, dated Jun. 23, 2015.
English translation of Written opinion for PCT Application No. PCT/JP2015/059279.

* cited by examiner

[Fig. 1A]
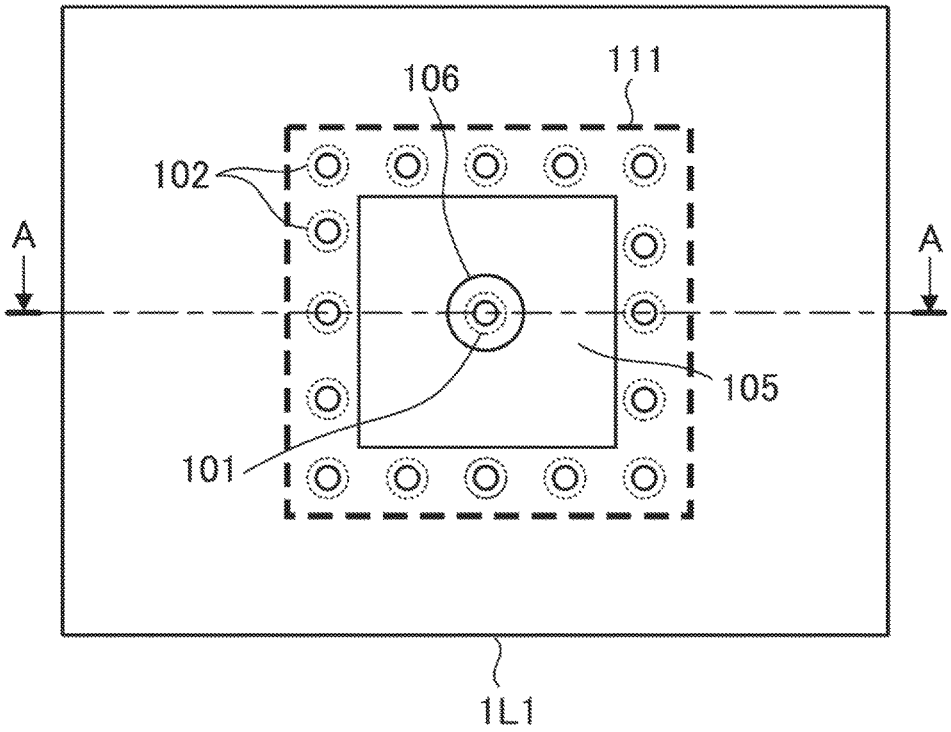

[Fig. 1B]
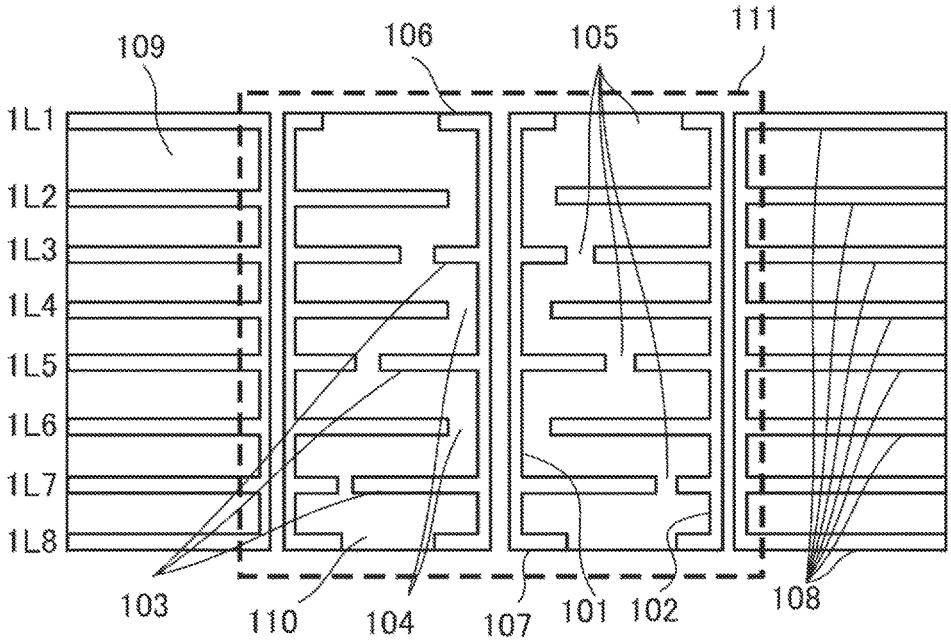

[Fig. 1C]
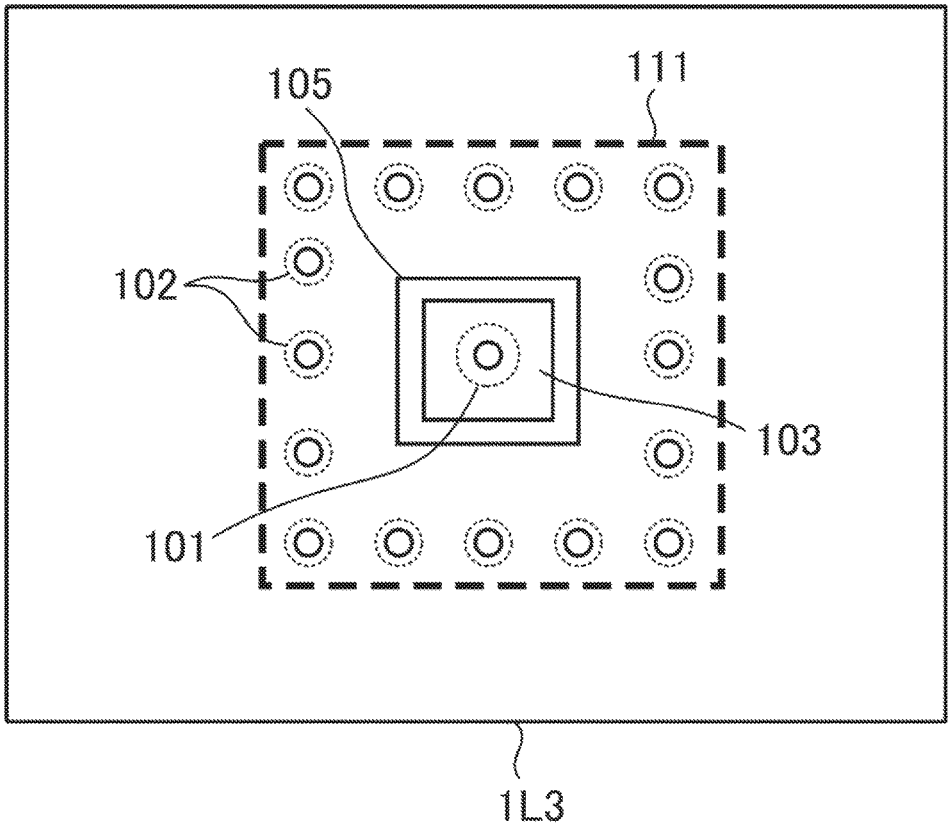

[Fig. 1D]
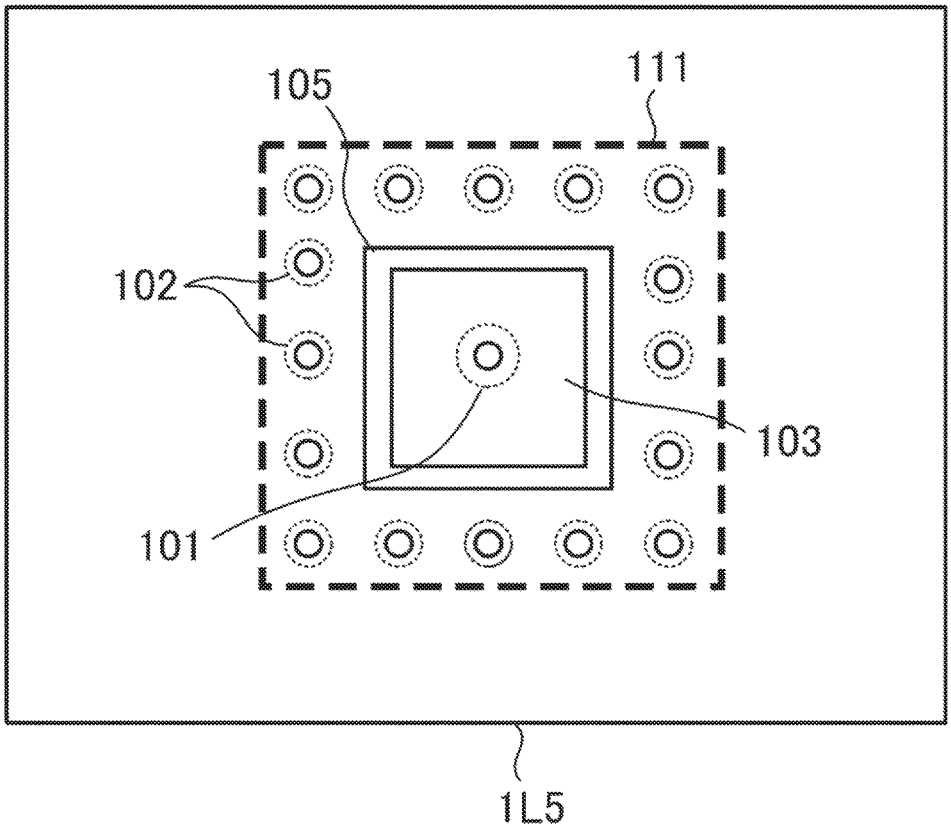

[Fig. 1E]
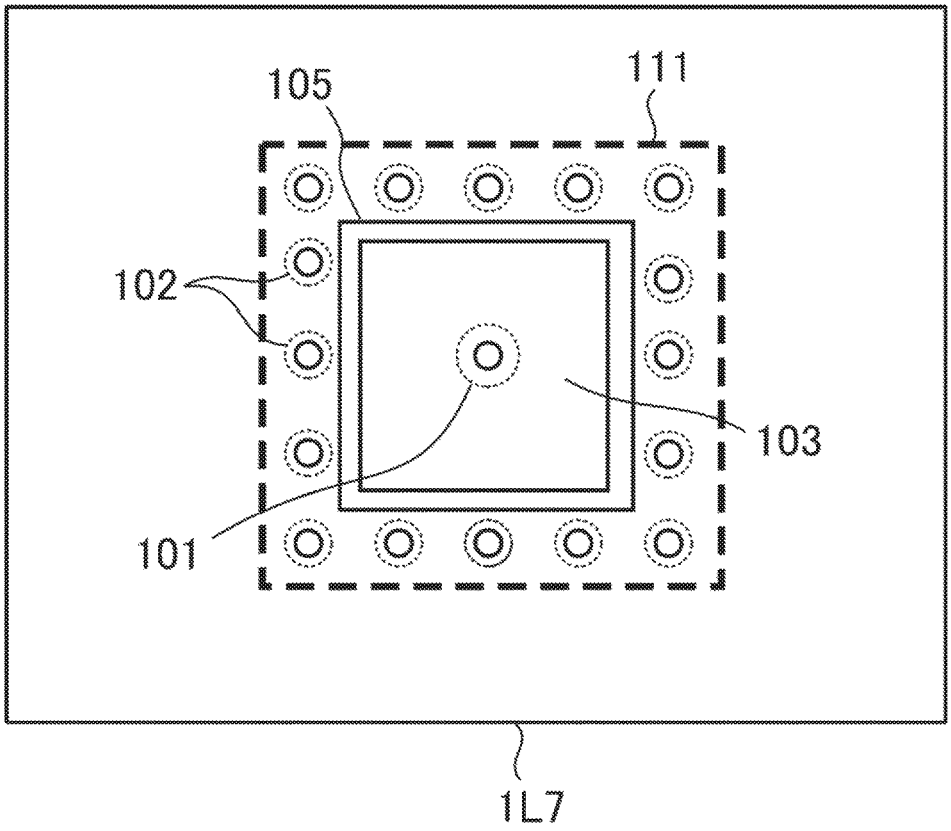

[Fig. 1F]
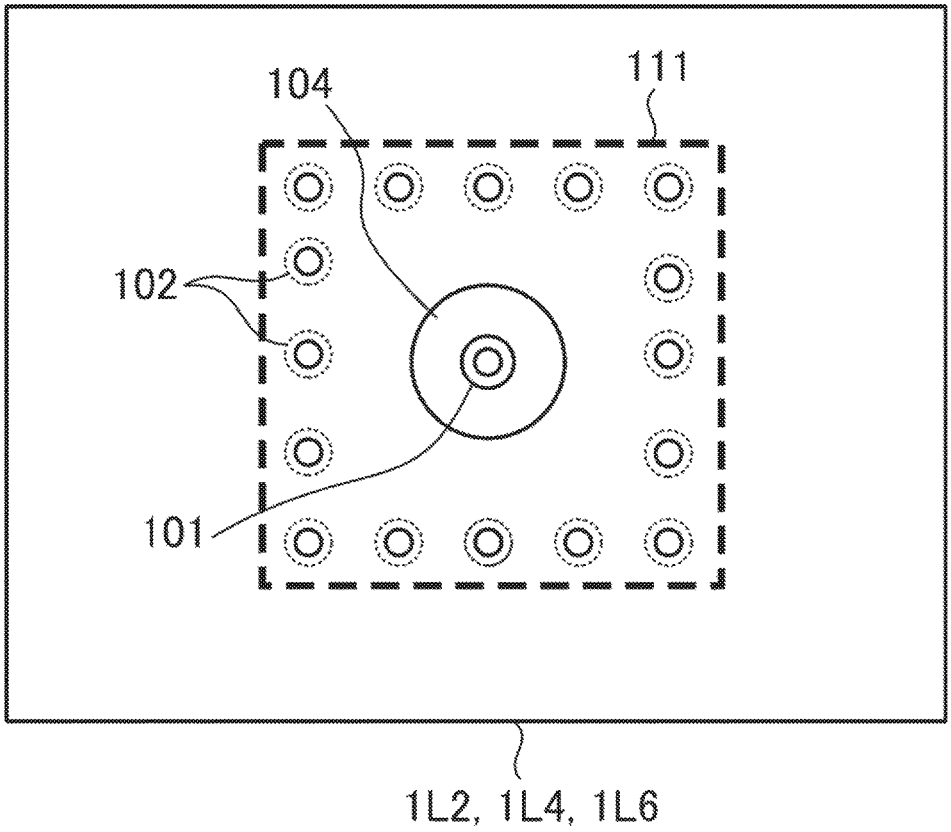

[Fig. 1G]
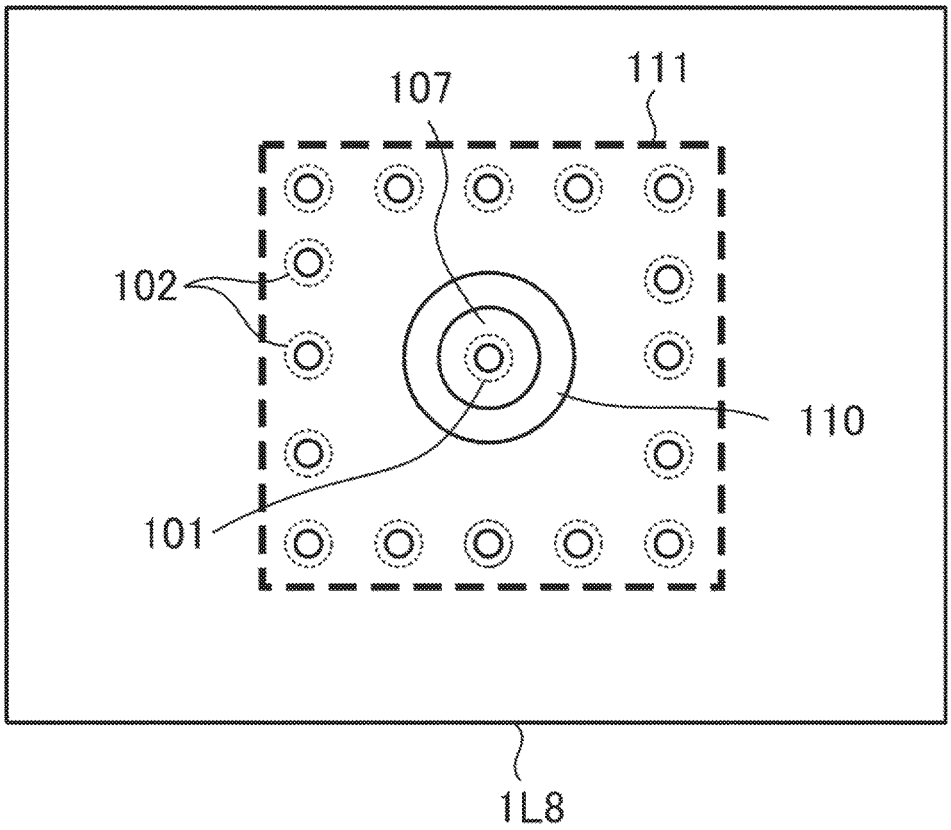

[Fig. 1H]
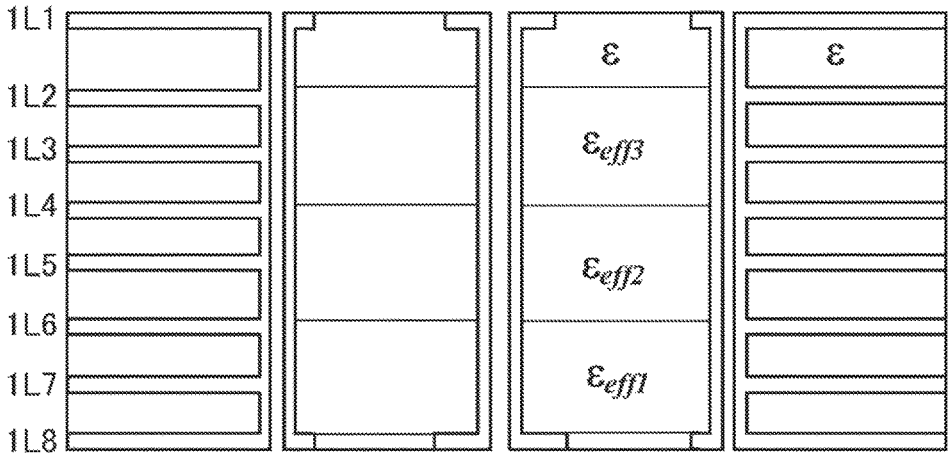

[Fig. 11]
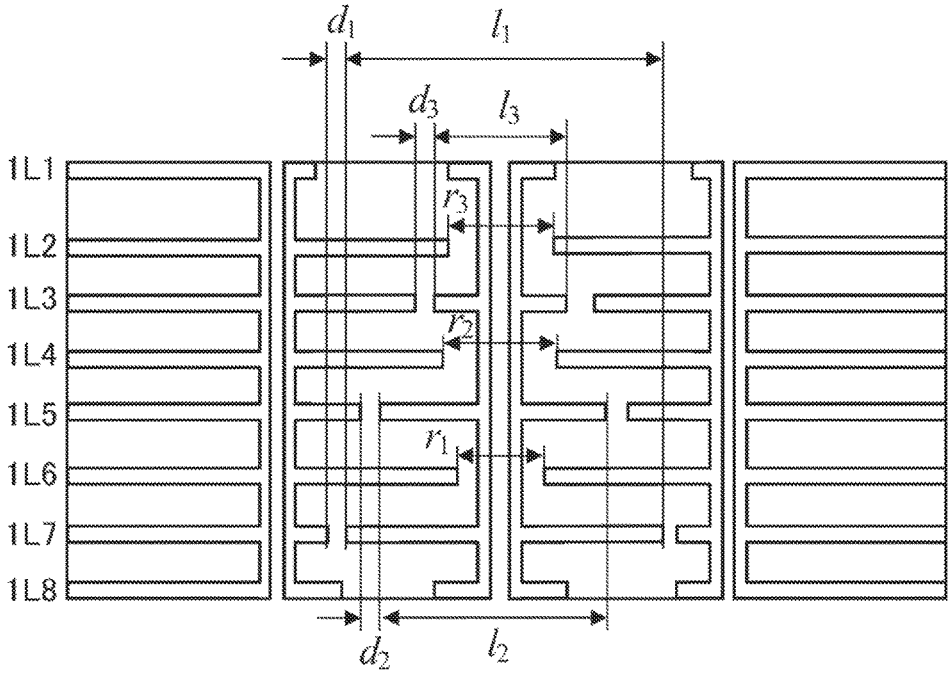

[Fig. 2A]
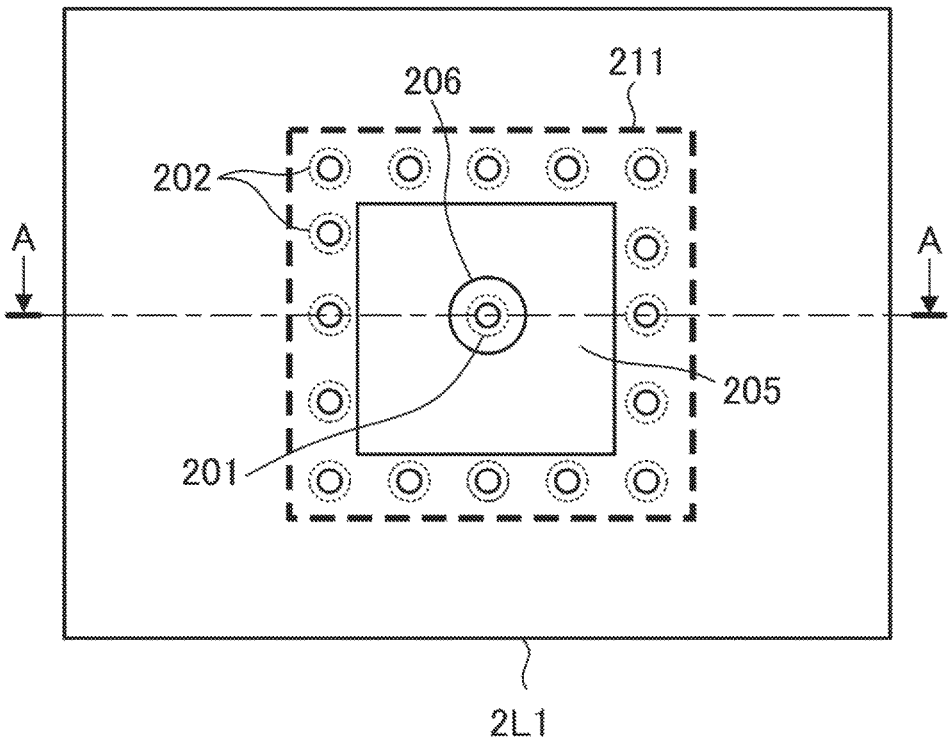

[Fig. 2B]
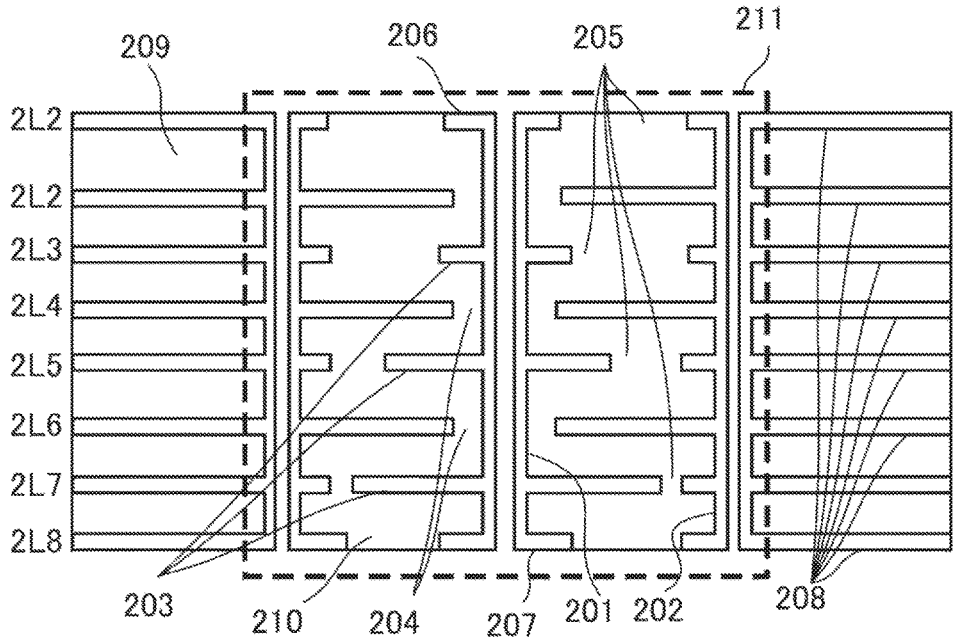

[Fig. 2C]
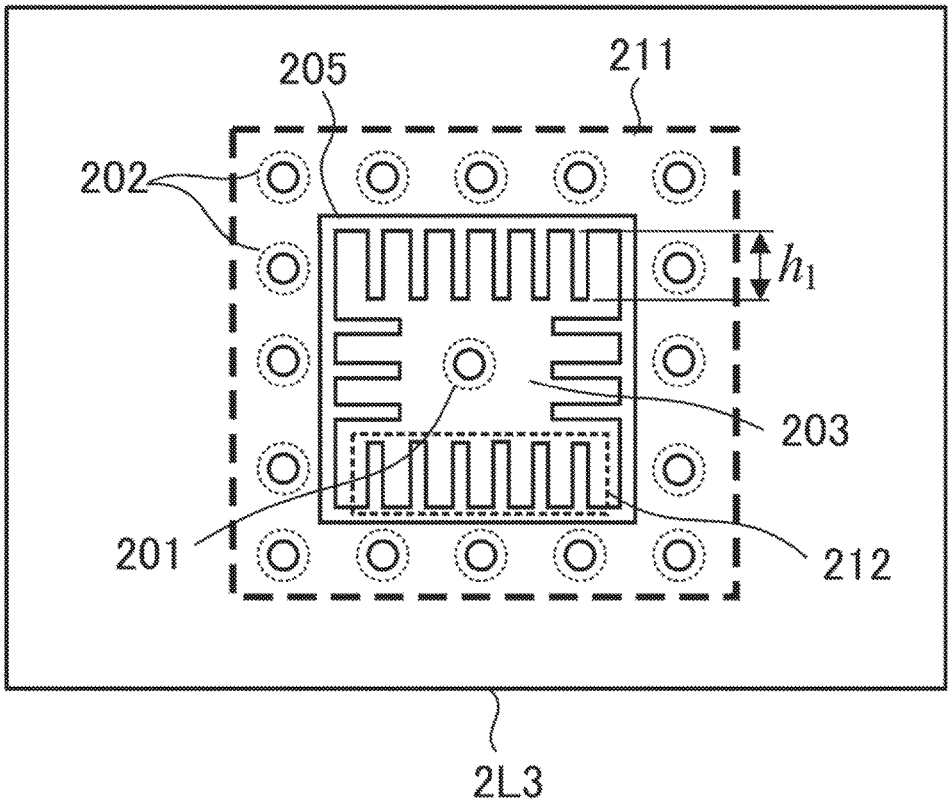

[Fig. 2D]
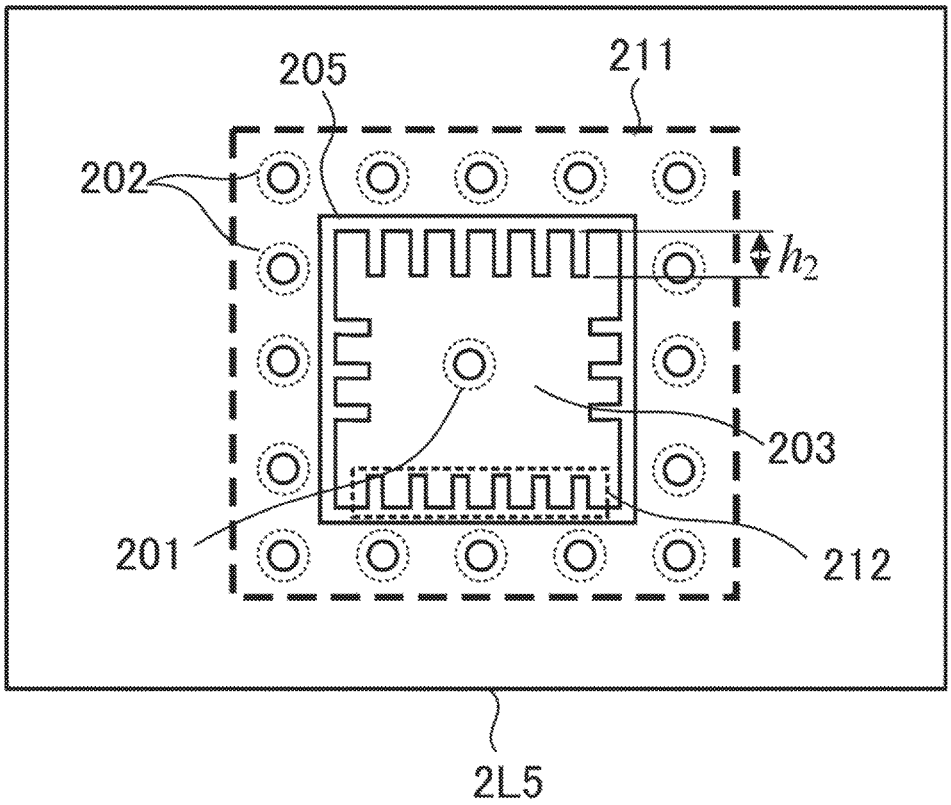

[Fig. 2E]
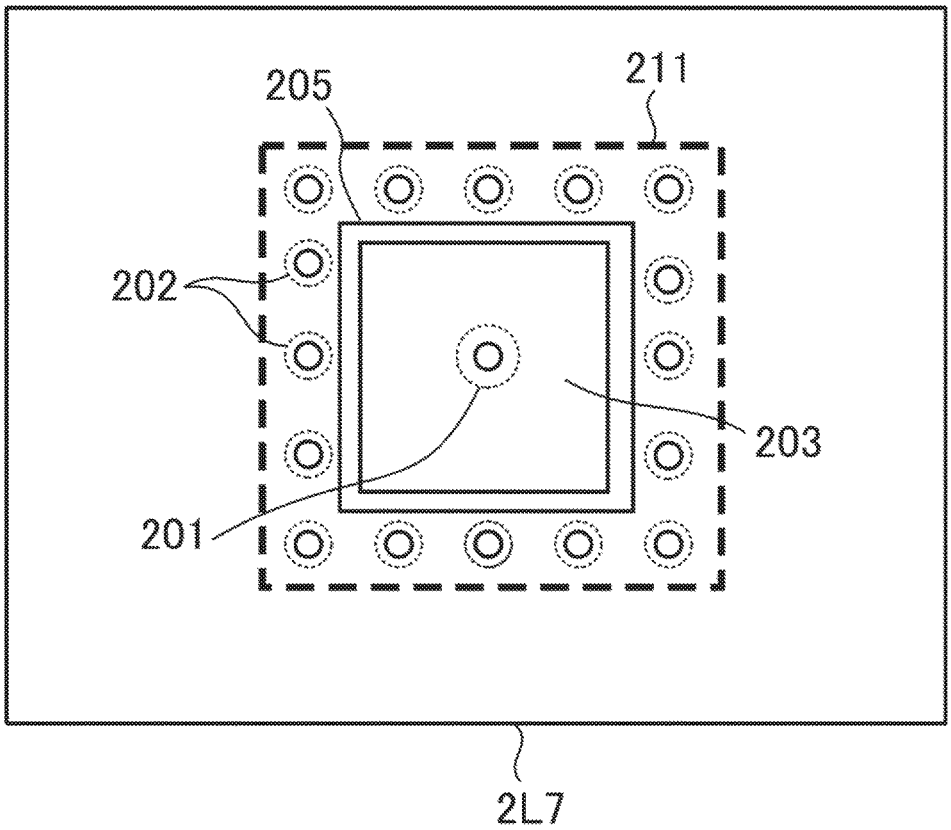

[Fig. 2F]
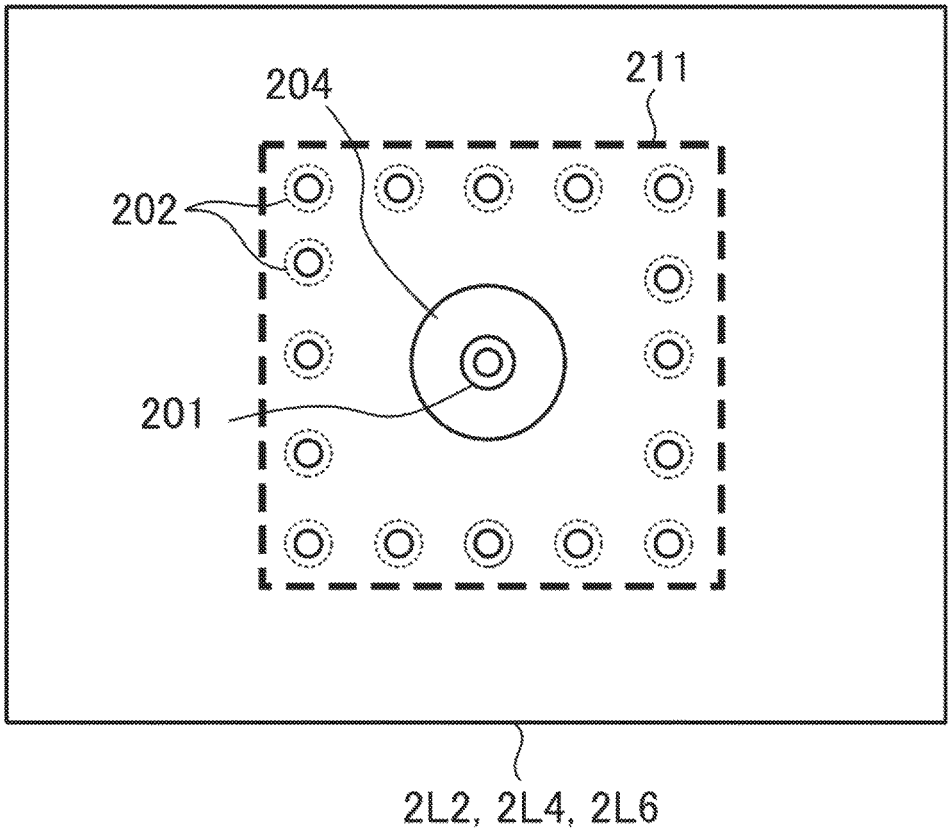

[Fig. 2G]
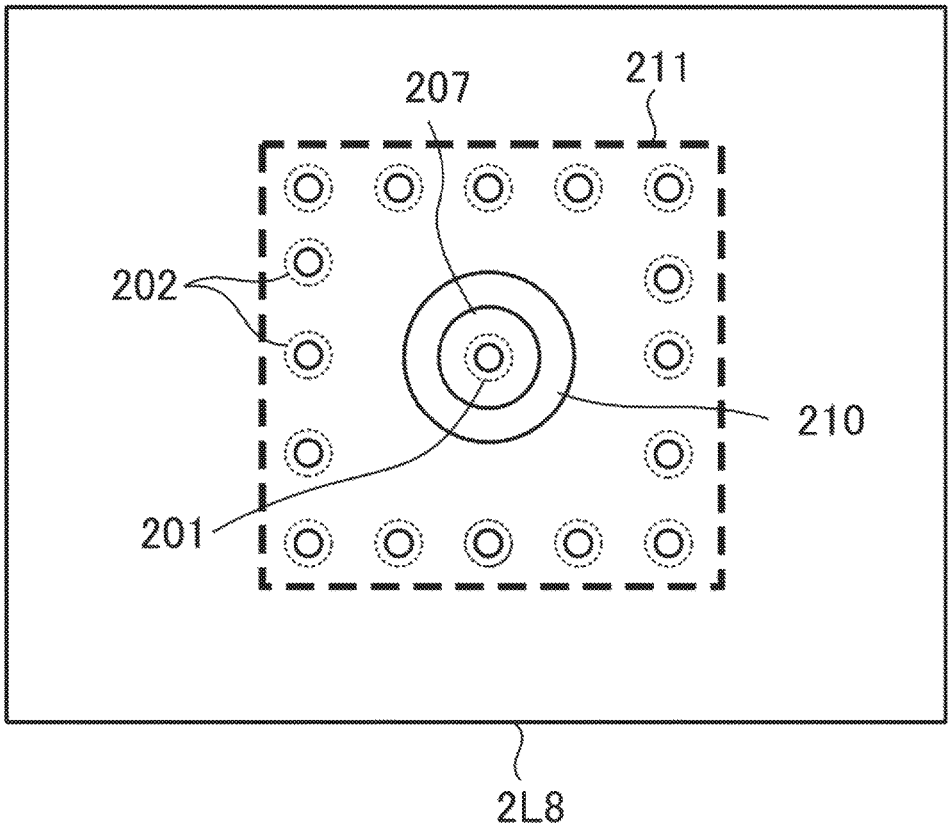

[Fig. 3A]
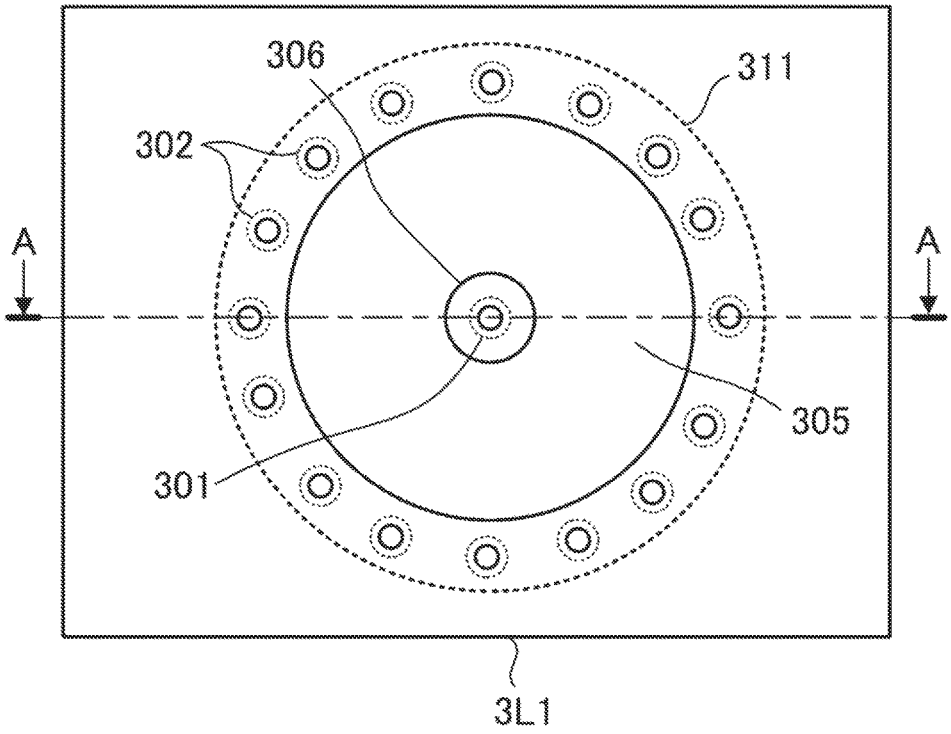

[Fig. 3B]
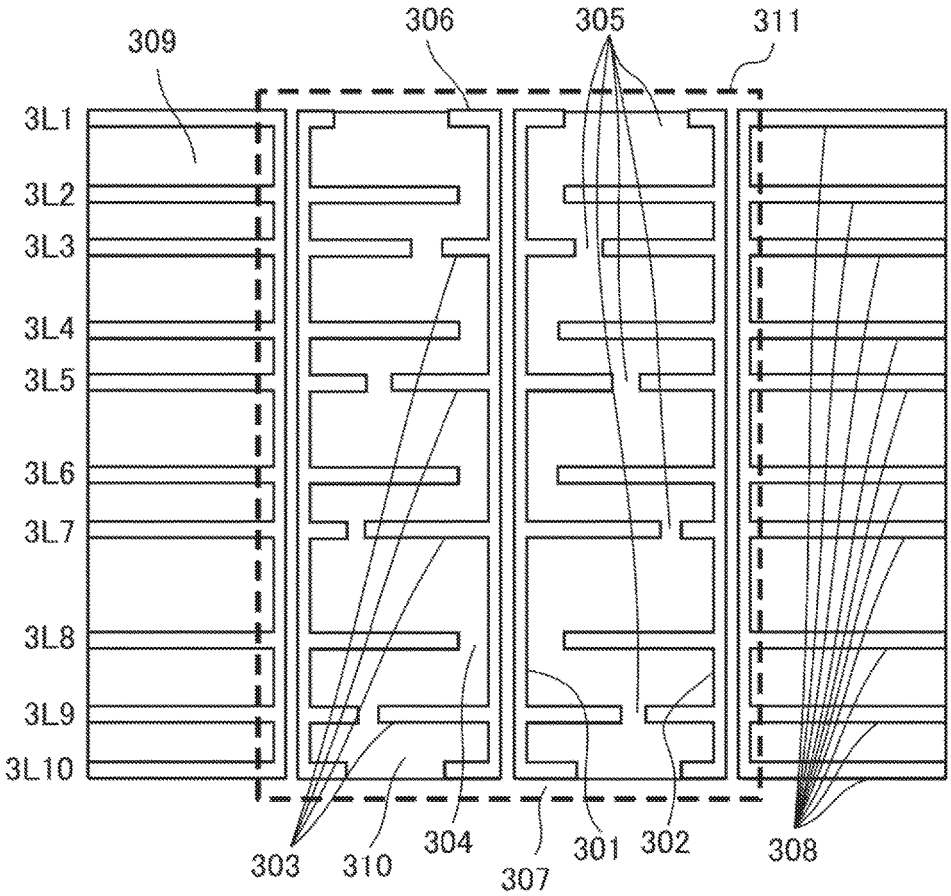

[Fig. 3C]
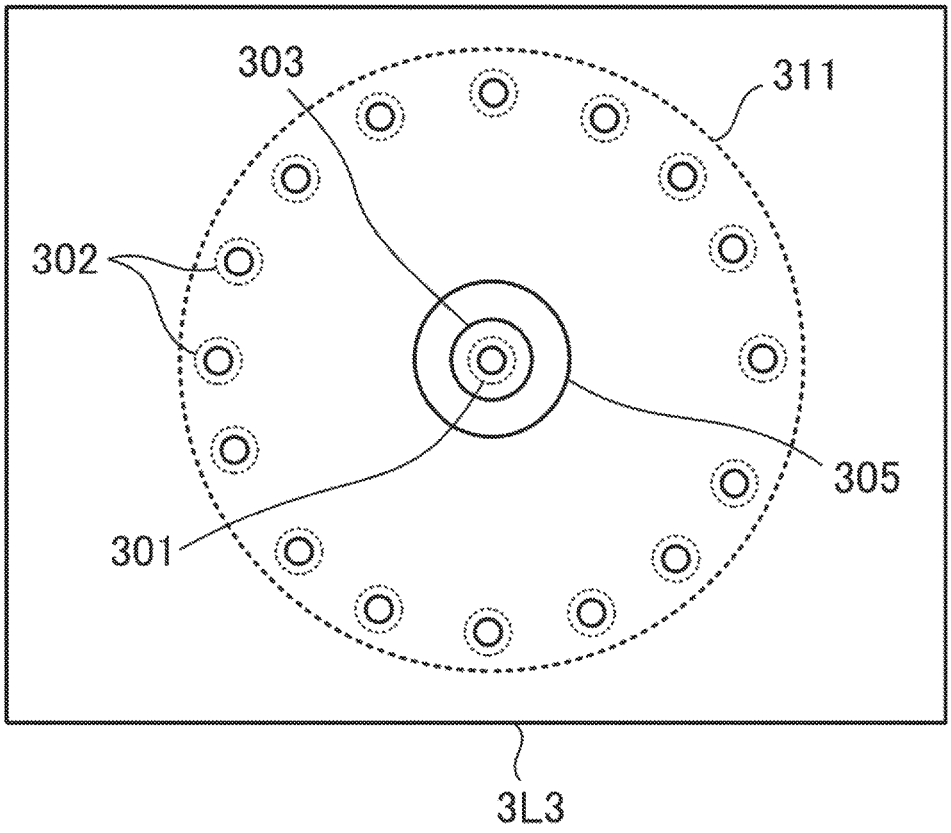

[Fig. 3D]
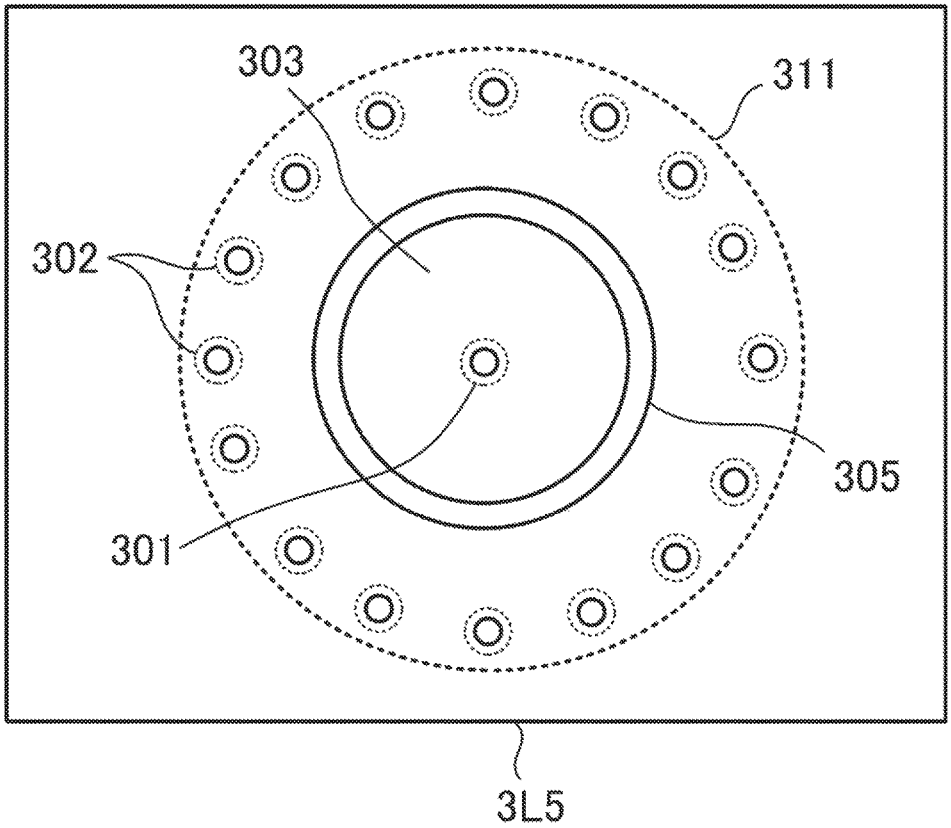

[Fig. 3E]
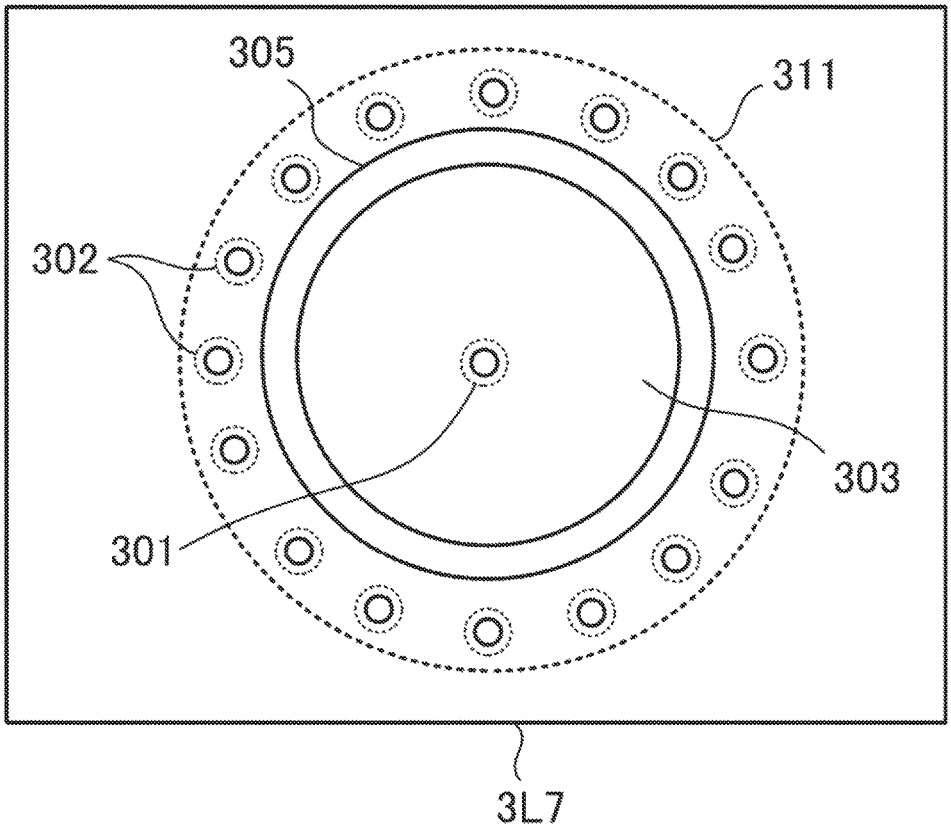

[Fig. 3F]
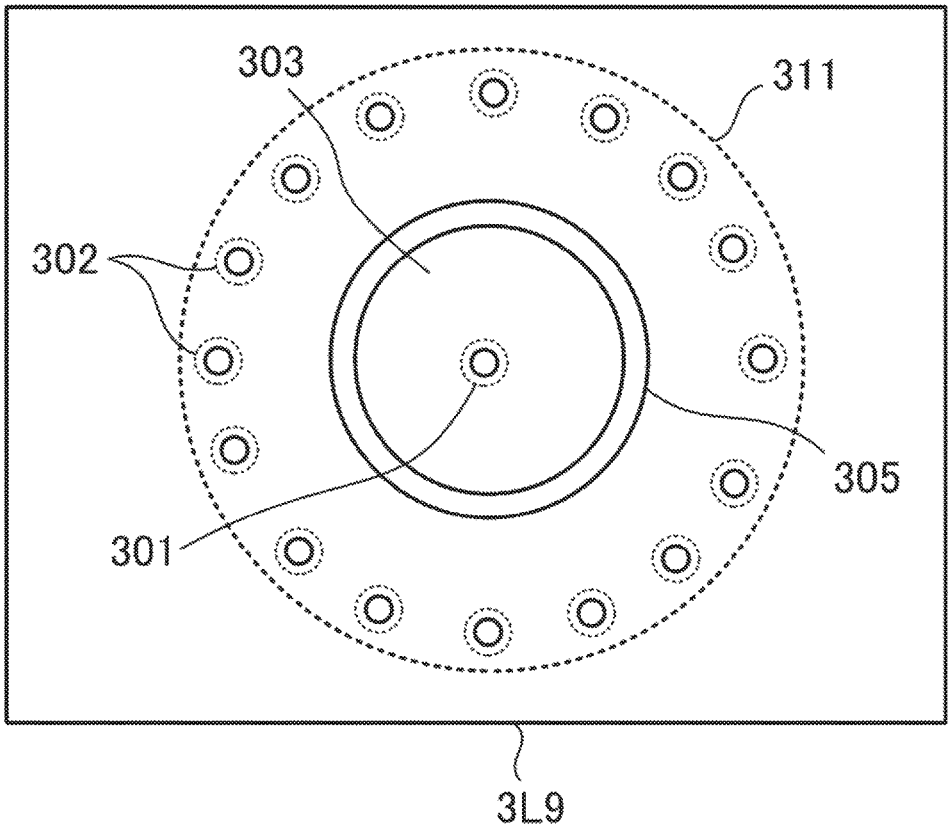

[Fig. 3G]
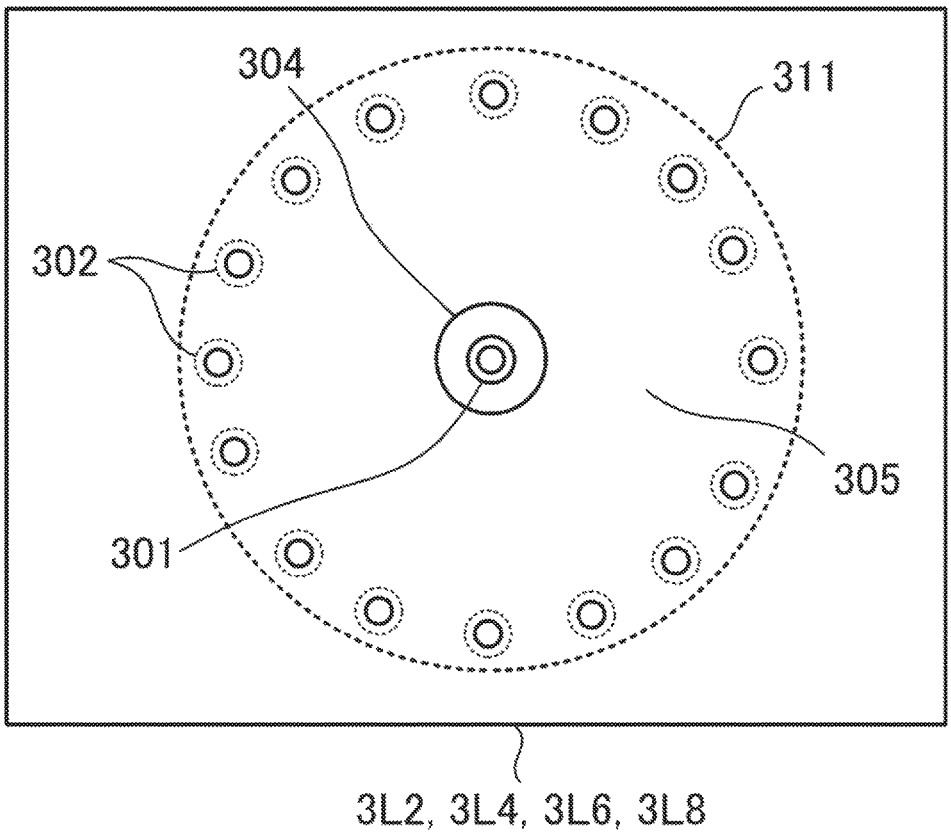

[Fig. 3H]
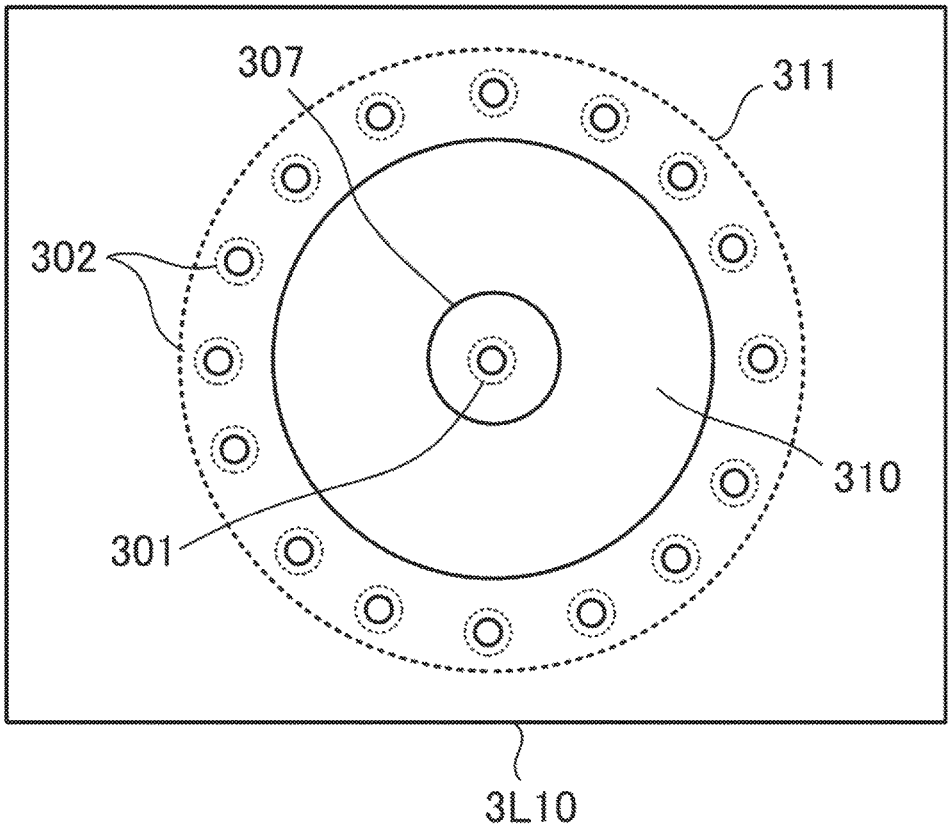

[Fig. 3I]
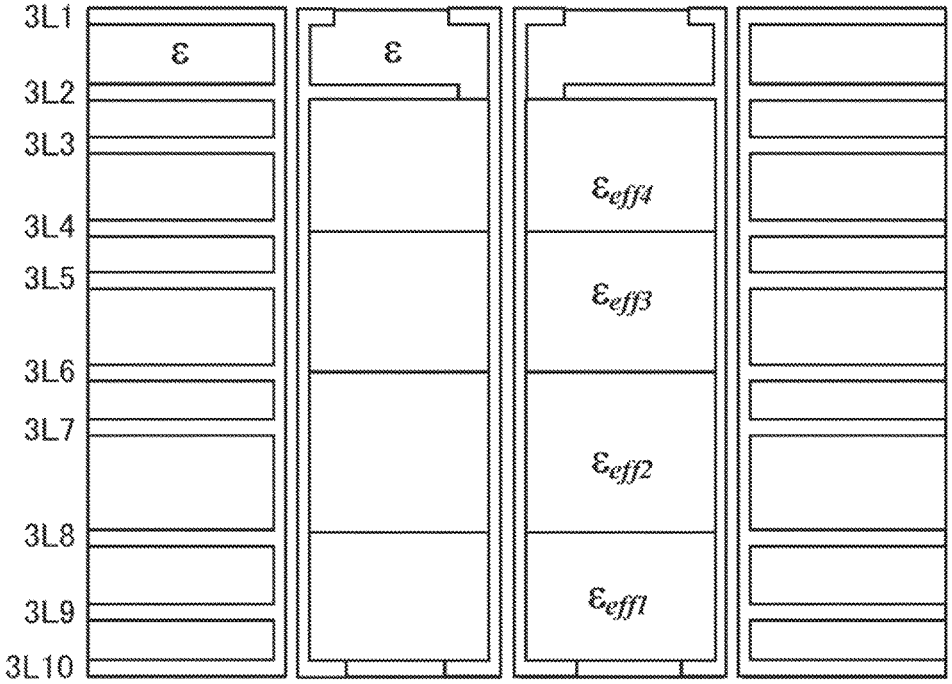

[Fig. 4A]
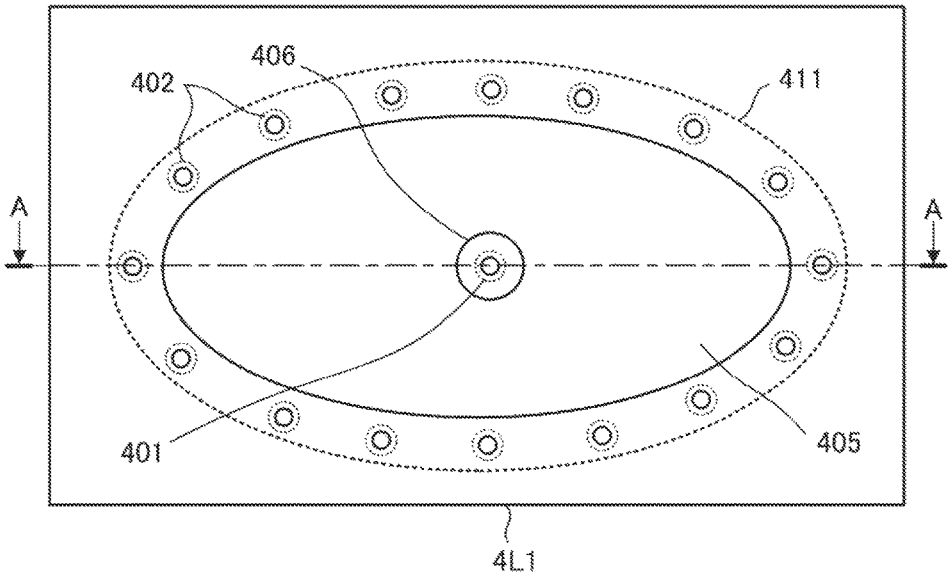

[Fig. 4B]
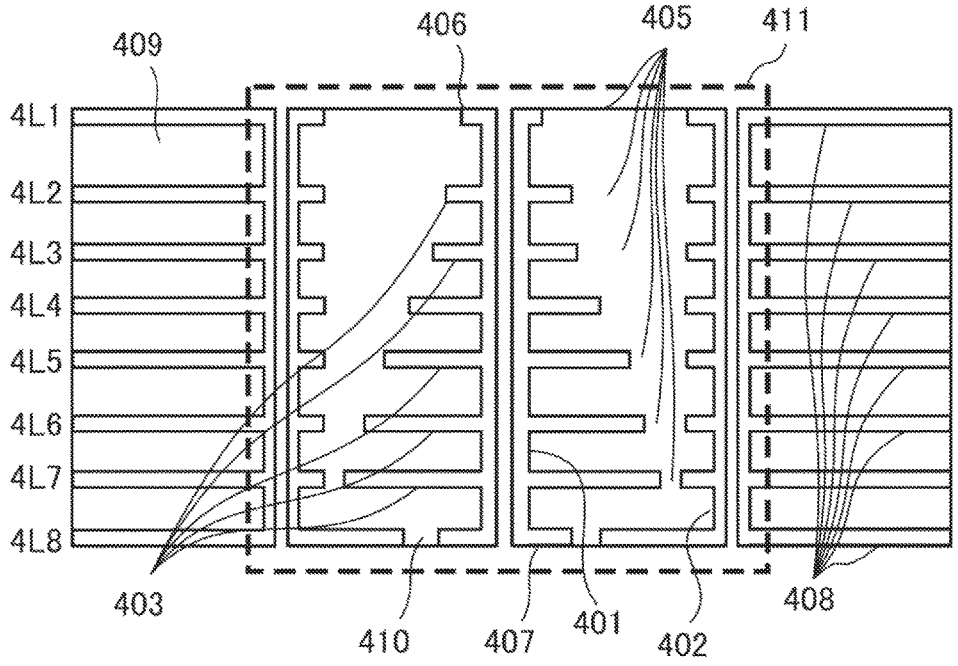

[Fig. 4C]
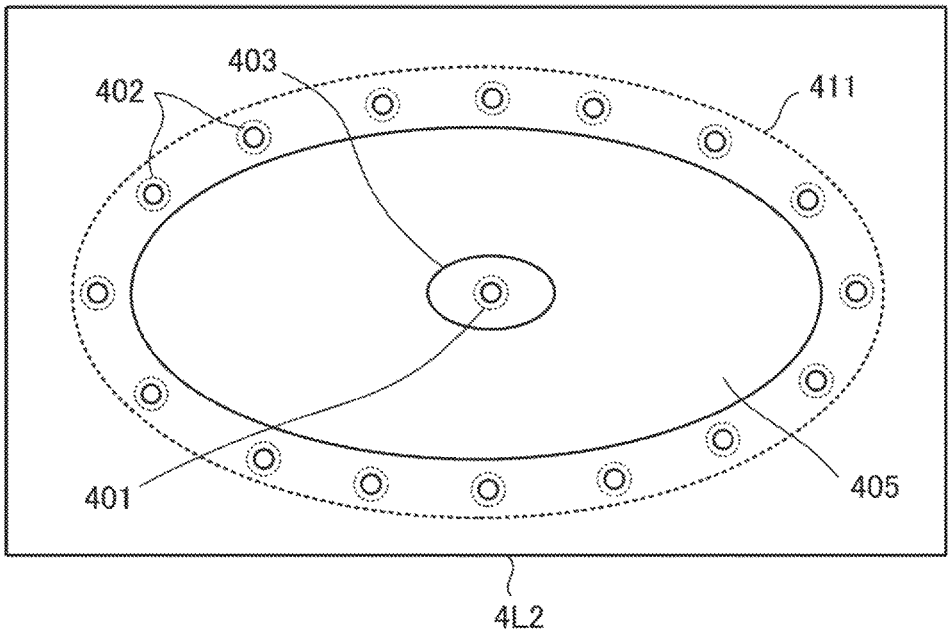

[Fig. 4D]
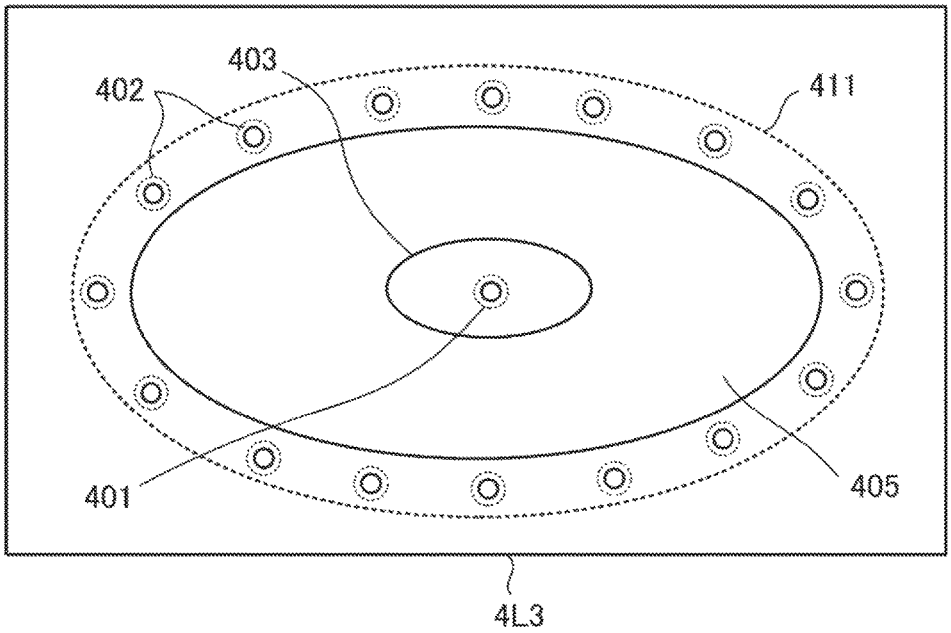

[Fig. 4E]
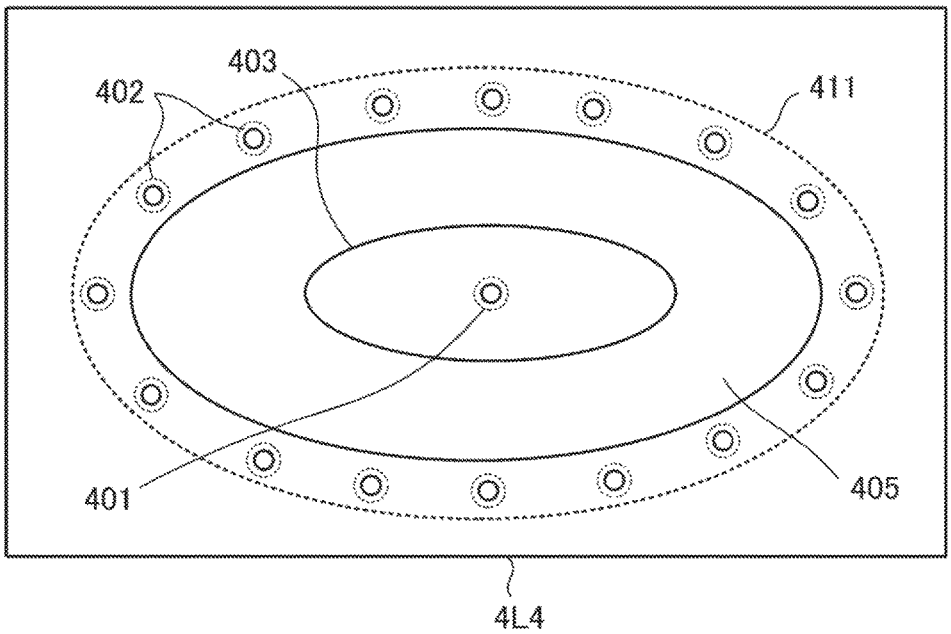

[Fig. 4F]
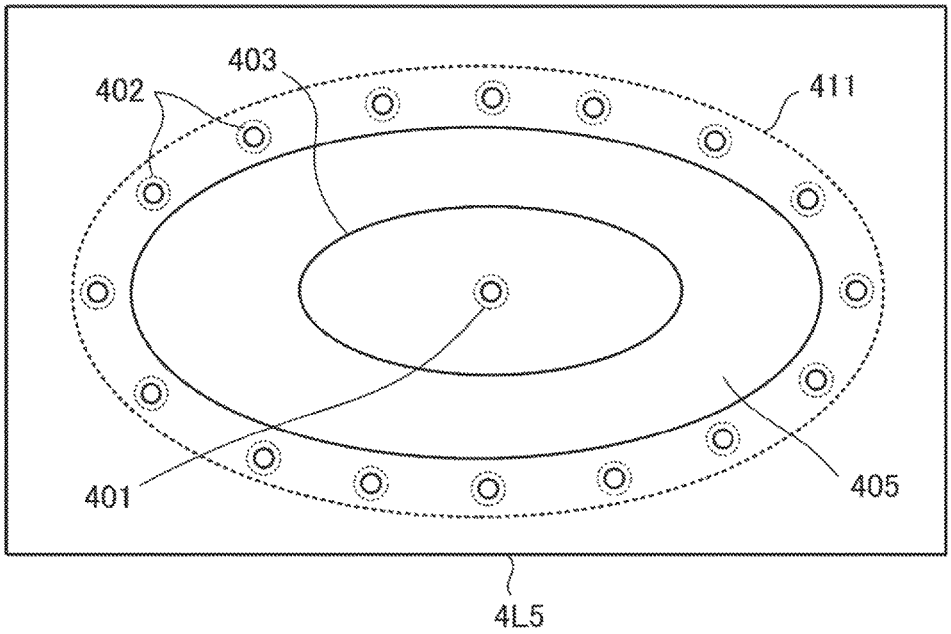

[Fig. 4G]
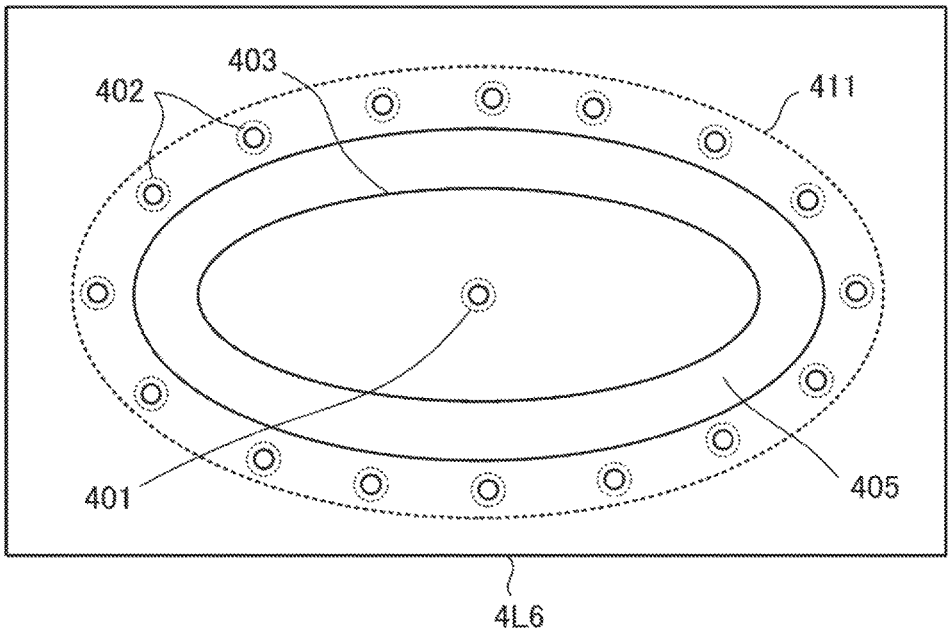

[Fig. 4H]
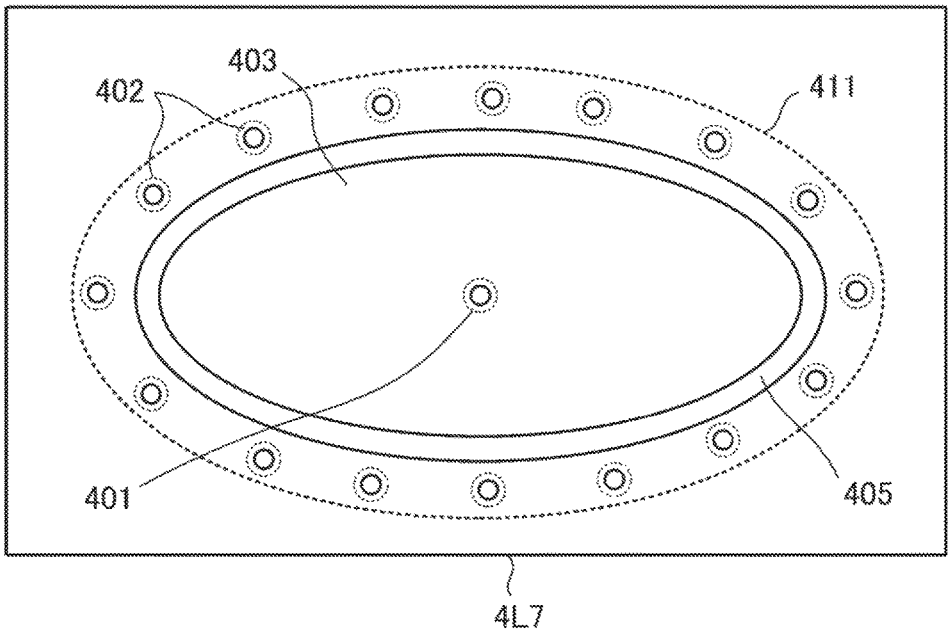

[Fig. 4I]
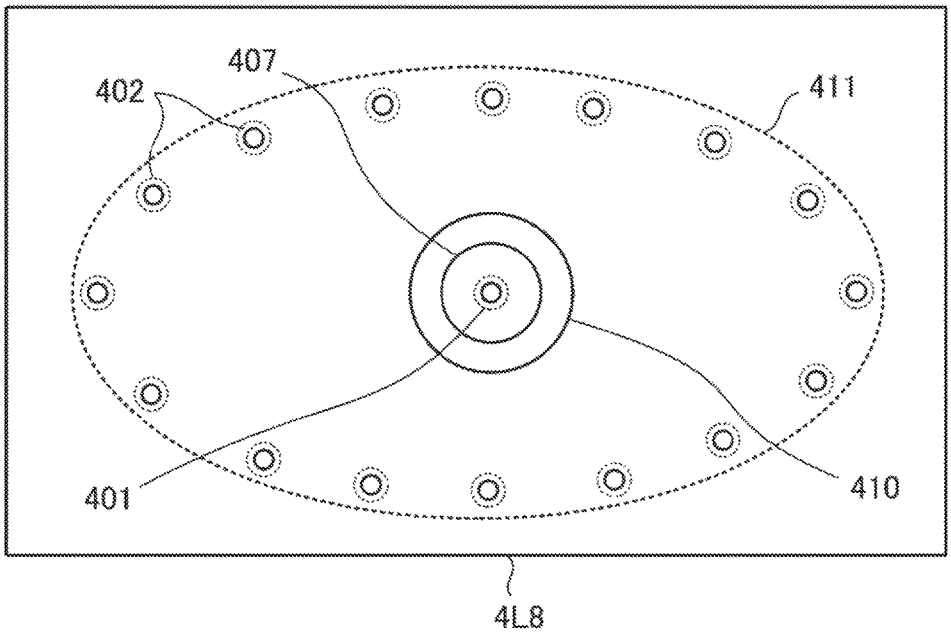

[Fig. 5]
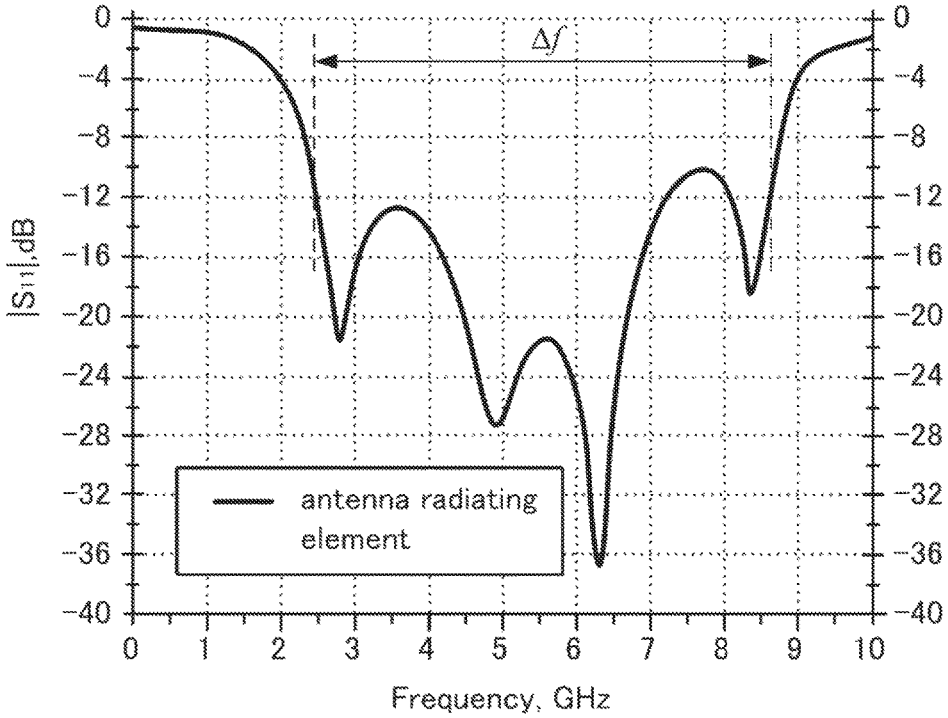

[Fig. 6]
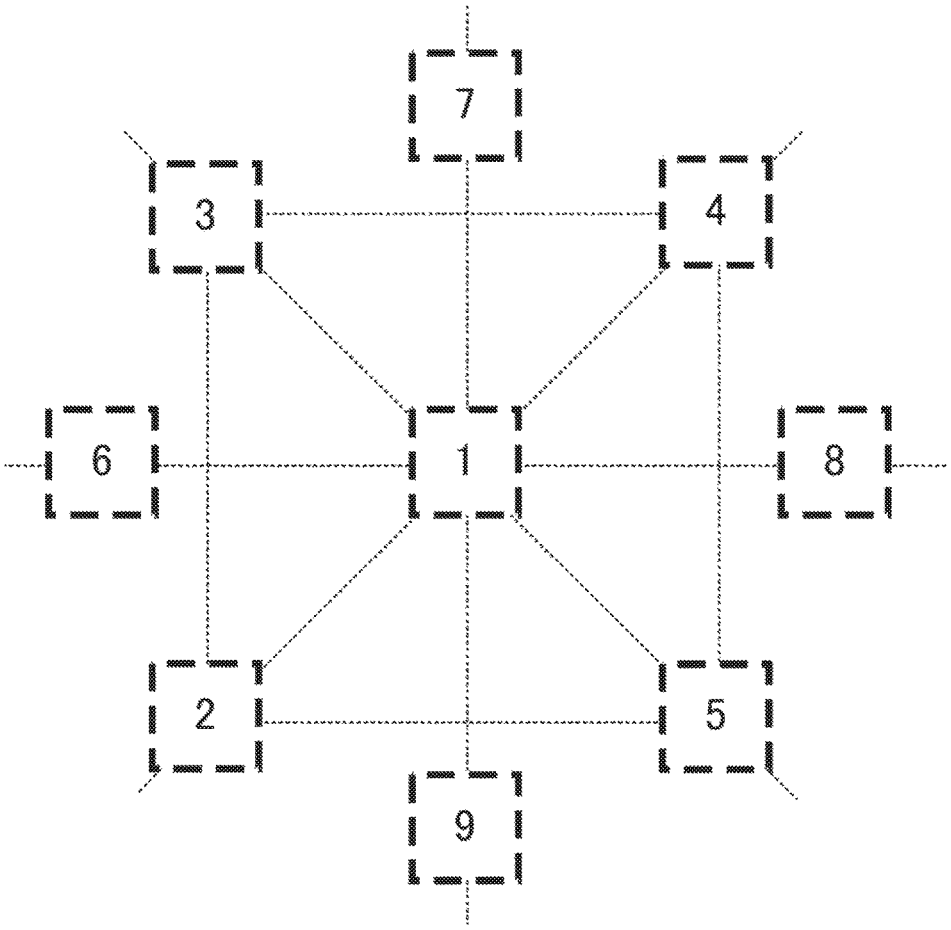

ANTENNA RADIATING ELEMENTS AND SPARSE ARRAY ANTENNAS AND METHOD FOR PRODUCING AN ANTENNA RADIATING ELEMENT

This application is a National Stage Entry of PCT/JP2015/059279 filed on Mar. 19, 2015, the contents of all of which are incorporated herein by reference, in their entirety.

TECHNICAL FIELD

The present invention relates to an antenna radiating elements, sparse array antennas and method for producing an antenna radiating element.

BACKGROUND ART

Compact sparse array antennas, operating in a wide frequency band, for radar sensing systems based on specific antenna radiating elements formed in a multilayer substrate and having considerably reduced dimensions due to application of an artificial medium (metamaterial) of a high relative permittivity.

As a way to improve the electrical performance of a radar system, a high-gain antenna can be used. Especially, such problem is crucial in remote sensing of an undersurface or hidden object due to its small signal reflectivity. Also, to provide radar imaging of such object, an antenna has to be operating in a wide frequency band. However, a typical wideband antenna (such as phase or sparse array antenna) used in a radar system has large dimensions, especially, at a low-gigahertz frequency range, that considerably limits areas of its applications.

Thus, it is important to develop such antenna systems which will be compact and, as a result, can be used in a lightweight radar system having wide application areas.

SUMMARY OF INVENTION

Technical Problem

The present invention enables to provide a technique of solving the above-described problem.

Solution to Problem

One aspect of the present invention provides an antenna radiating element disposed in a multilayer substrate comprising a signal via, a plurality of ground vias surrounding the signal via, a radiation pad connected to one end of the signal via, a feed pad connected to another end of the signal vias, an artificial medium disposed between the signal via and the ground vias, and wherein the multilayer substrate comprises a plurality of conductor layers isolated by a dielectric material.

Another aspect of the present invention provides a sparse array antenna comprising a plurality of antenna radiating elements disposed in a multilayer substrate, wherein the antenna radiating elements comprises a signal via, a plurality of ground vias surrounding the signal via, a radiation pad connected to one end of the signal via, a feed pad connected to another end of the signal vias, an artificial medium disposed between the signal via and the ground vias, and wherein the multilayer substrate comprises a plurality of conductor layers isolated by a dielectric material.

Advantageous Effects of Invention

According to the present invention, it is possible to provide a compact array antennas are provided by development of small antenna radiating elements and a sparse arrangement of these elements.

BRIEF DESCRIPTION OF DRAWINGS

FIG. 1A is a top view of a radiating element for a sparse array antenna in an exemplary embodiment of the present embodiment.

FIG. 1B is a vertical cross-sectional view of the radiating element shown in FIG. 1A on the A-A section.

FIG. 1C is a horizontal cross-sectional view of the radiating element shown in FIG. 1B on 1L3 conductor layer.

FIG. 1D is a horizontal cross-sectional view of the radiating element shown in FIG. 1B on 1L5 conductor layer.

FIG. 1E is a horizontal cross-sectional view of the radiating element shown in FIG. 1B on 1L7 conductor layer.

FIG. 1F is a horizontal cross-sectional view of the radiating element shown in FIG. 1B on 1L2, 1L4 and 1L6 conductor layers.

FIG. 1G is a bottom view of the radiating element shown in FIG. 1B.

FIG. 1H is the vertical cross-sectional view of the radiating element shown in FIG. 1B in which a structure between signal and ground vias is replaced by the corresponding homogeneous medium with the effective relative permittivity $epsilon_{eff1}$, $epsilon_{eff2}$, or $epsilon_{eff3}$ as dependency on the conductor layer.

FIG. 1I is the vertical cross-sectional view of the radiating element shown in FIG. 1B.

FIG. 2A is a top view of a radiating element for a sparse array antenna in another exemplary embodiment of the present embodiment.

FIG. 2B is a vertical cross-sectional view of the radiating element shown in FIG. 2A on the A-A section.

FIG. 2C is a horizontal cross-sectional view of the radiating element shown in FIG. 2B on 2L3 conductor layer.

FIG. 2D is a horizontal cross-sectional view of the radiating element shown in FIG. 2B on 2L5 conductor layer.

FIG. 2E is a horizontal cross-sectional view of the radiating element shown in FIG. 2B on 2L7 conductor layer.

FIG. 2F is a horizontal cross-sectional view of the radiating element shown in FIG. 2B on 2L2, 2L4 and 2L6 conductor layers.

FIG. 2G is a bottom view of the radiating element shown in FIG. 2B.

FIG. 3A is a top view of a radiating element for a sparse array antenna in another exemplary embodiment of the present embodiment.

FIG. 3B is a vertical cross-sectional view of the radiating element shown in FIG. 3A on the A-A section.

FIG. 3C is a horizontal cross-sectional view of the radiating element shown in FIG. 3B on 3L3 conductor layer.

FIG. 3D is a horizontal cross-sectional view of the radiating element shown in FIG. 3B on 3L5 conductor layer.

FIG. 3E is a horizontal cross-sectional view of the radiating element shown in FIG. 3B on 3L7 conductor layer.

FIG. 3F is a horizontal cross-sectional view of the radiating element shown in FIG. 3B on 3L9 conductor layer.

FIG. 3G is a horizontal cross-sectional view of the radiating element shown in FIG. 3B on 3L2, 3L4, 3L6, 3L8 conductor layers.

FIG. 3H is a bottom view of the radiating element shown in FIG. 3B.

FIG. 3I is the vertical cross-sectional view of the radiating element shown in FIG. 3B in which a structure between signal and ground vias is replaced by the corresponding homogeneous medium with effective relative permittivity $epsilon_{eff1}$, $epsilon_{eff2}$, $epsilon_{eff3}$, or $epsilon_{eff4}$ as dependency on the conductor layer.

FIG. 4A is a top view of a radiating element for a sparse array antenna in another exemplary embodiment of the present embodiment.

FIG. 4B is a vertical cross-sectional view of the radiating element shown in FIG. 4A on the A-A section.

FIG. 4C is a horizontal cross-sectional view of the radiating element shown in FIG. 4B on 4L2 conductor layer.

FIG. 4D is a horizontal cross-sectional view of the radiating element shown in FIG. 4B on 4L3 conductor layer.

FIG. 4E is a horizontal cross-sectional view of the radiating element shown in FIG. 4B on 4L4 conductor layer.

FIG. 4F is a horizontal cross-sectional view of the radiating element shown in FIG. 4B on 4L5 conductor layer.

FIG. 4G is a horizontal cross-sectional view of the radiating element shown in FIG. 4B on 4L6 conductor layer.

FIG. 4H is a horizontal cross-sectional view of the radiating element shown in FIG. 4B on 4L7 conductor layer.

FIG. 4I is a bottom view of the radiating element shown in FIG. 4B.

FIG. 5 is a graph showing simulated return loss of the radiating element shown in FIGS. 1A-1I.

FIG. 6 is an arrangement of the radiation elements (nine) proposed to form a sparse array antenna.

DESCRIPTION OF EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Hereinafter, several types of compact radiating elements for sparse array antennas disposed in multilayer substrates according to the present embodiment will be described in details with reference to attached drawings. But, it would be well understood that this description should not be viewed as narrowing the appended claims.

In FIGS. 1A to 1I, an exemplary embodiment of an antenna radiating element 111 disposed in a multilayer substrate is shown. This multilayer substrate is provided with a plurality of conductor layers 1L1 to 1L8. Eight conductor layers 1L1 to 1L8 are isolated by a dielectric material 109.

Note this eight conductor layer substrate is only an example of multilayer substrates and a number of conductor layers, filling material and other substrate parameters can be different that depends on an application.

In present embodiment, said radiating element 111 comprises a signal via 101 and ground vias 102 surrounding said signal via 101 and connected to ground planes 108. Such radiating element 111 has low leakage losses and, as a result, a minor coupling to neighboring radiating elements forming a sparse array antenna. Said radiating element 111 has compact dimensions due to a high effective relative permittivity of an artificial medium (metamaterial) formed between said signal via 101 and said ground vias 102. This artificial medium is obtained by conductor plates 103 connected to said signal via 101 and conductor plates 108 connected to said ground vias 102. Said conductor plates 103 are separated from said ground conductor plates 108 by isolating slits 105, and said ground conductor plates 108 are isolated from said signal via 101 by clearance holes 104. A radiation pad 106 is connected to one end of said signal via 101 and another end of said signal via 101 is connected to a feed pad 107. Said radiation pad 106 is separated from the ground plate 108 disposed at the conductor layer 1L1 by an isolating slit 105. Said feed pad 107 is separated from the ground plate 108 disposed at the conductor layer 1L8 by an isolated slit 110.

Distinguishing point of said artificial medium is variability of its effective relative permittivity in the vertical direction, that is, perpendicularly to the surface of said multilayer substrate. In FIG. 1H a physical model of the artificial medium between signal via 101 and ground vias 102 is presented. This artificial medium can be characterized by the effective relative permittivity, $epsilon_{eff1}$, $epsilon_{eff2}$, or $epsilon_{eff3}$ each of which is dependent on dimensions of conductor plates 103, isolating slits 105 and clearance holes 104. That is, $epsilon_{eff1}$, is function of $d_1$, $l_1$, $r_1$ (see FIG. 1I): $epsilon_{eff1}=f(d_1, l_1, r_1)$. Also, $epsilon_{eff2}=f(d_2, l_2, r_2)$ and $epsilon_{eff3}=f(d_3, l_3, r_3)$. To provide a wideband operation of said radiating element 111 dimensions of conductor plates are chosen in such way that $l_1$ greater than $l_2$ greater than $l_3$ and, as a result, $epsilon_{eff1}$ greater than $epsilon_{eff2}$ greater than $epsilon_{eff3}$. This condition leads to widening the operation band of said radiating element 111. In presented embodiment of said radiating element 111, ground vias are arranged as a square. And said conductor plates 103 have also a square form.

In an aspect of the present embodiment, a compact array antennas are provided by development of small antenna radiating elements and a sparse arrangement of these elements. An antenna radiating element proposed is formed by a signal via surrounding by ground vias. Compactness of such element is provided by an artificial medium (metamaterial) of a high effective permittivity, which is disposed between a signal and ground vias forming the radiating element. Its wideband operation is achieved by development of such artificial medium which has variable effective permittivity in the vertical direction (perpendicular to the substrate surface).

An antenna radiating element proposed is formed by a signal via surrounding by ground vias. Compactness of such element is provided by an artificial medium (metamaterial) of a high effective permittivity, which is disposed between a signal and ground vias forming the radiating element. Its wideband operation is achieved by development of such artificial medium which has variable effective permittivity in the vertical direction (perpendicular to the substrate surface).

Second Embodiment

In FIGS. 2A to 2G, another embodiment of the antenna radiating element disposed in a multilayer substrate is shown. The multilayer substrate is provided with a plurality of conductor layers 2L1 to 2L8. Eight conductor layers 2L1 to 2L8 are isolated by a dielectric material 209. In present another embodiment, an antenna radiating element 211 comprises a signal via 201 and ground vias 202 surrounding said signal via 201 and connected to ground planes 208. In said radiating element 211, an artificial medium of a high effective relative permittivity is formed between said signal via 201 and said ground vias 202. This artificial medium is obtained by conductor plates 203 connected to said signal via 201 and conductor plates 208 connected to said ground vias 202. Said conductor plates 203 are separated from said ground conductor plates 208 by isolating slits 205, and said ground conductor plates 208 are isolated from said signal via 201 by clearance holes 204. A radiation pad 206 is connected to one end of said signal via 201 and another end of said signal via 201 is connected to a feed pad 207. Said radiation pad 206 is separated from the ground plate 208 disposed at the conductor layer 2L1 by an isolating slit 205. Said feed pad 207 is separated from the ground plate 208 disposed at the conductor layer 2L8 by an isolated slit 210. In this embodiment, a change of the effective relative permittivity of the artificial medium in the vertical direction is provided by a corrugation 212 of said conductor plates 203 disposed at conductor layers 2L3 and 2L5 as well as by the use of a smooth form of said conductor plate 203 arranged at the conductor layer 2L7. The depths $h_1$ and $h_2$ of said corrugation 212 are different at conductor layers 2L3 and 2L5 to obtain the change of the effective relative permittivity in the vertical direction.

It should be noted that arrangement of ground vias, the form of conductor plates, and a number of conductor layers in a multilayer substrate can be different to provide a required performance of an antenna radiating element.

Third Embodiment

In FIGS. 3A to 3I, another embodiment of the antenna radiating element disposed in a multilayer substrate is shown. The multilayer substrate is provided with a plurality of conductor layers 3L1 to 3L10. Ten conductor layers 3L1 to 3L10 are isolated by a dielectric material 309. In present another embodiment, an antenna radiating element 311 comprises a signal via 301 and ground vias 302 surrounding said signal via 301 and connected to ground planes 308. In said radiating element 311 an artificial medium of a high effective relative permittivity is formed between said signal via 301 and said ground vias 302. This artificial medium is obtained by conductor plates 303 connected to said signal via 301 and conductor plates 308 connected to said ground vias 302. Said conductor plates 303 are separated from said ground conductor plates 308 by isolating slits 305, and said ground conductor plates 308 are isolated from said signal via 301 by clearance holes 304. A radiation pad 306 is connected to one end of said signal via 301 and another end of said signal via 301 is connected to a feed pad 307. Said radiation pad 306 is separated from the ground plate 308 disposed at the conductor layer 3L1 by an isolating slit 305. Said feed pad 307 is separated from the ground plate 308 disposed at the conductor layer 3L10 by an isolated slit 310.

In present embodiment, a change of the effective relative permittivity of said artificial medium in the vertical direction is achieved by the variation of dimensions of said conductor plates 303. Moreover, to provide a better matching between said feed pad 307 and said radiation pad 306, dimensions of said conductor plates are chosen in such way that $epsilon_{eff1}$ less than $epsilon_{eff2}$ and $epsilon_{eff2}$ greater than $epsilon_{eff3}$ greater than $epsilon_{eff3}$ (see FIG. 3I). In this embodiment of said radiating element 311, ground vias are arranged as a circle. And said conductor plates 303 have also a circular form.

Fourth Embodiment

In FIGS. 4A to 4I, another embodiment of the antenna radiating element disposed in a multilayer substrate is shown. The multilayer substrate is provided with a plurality of conductor layers 4L1 to 4L8. Eight conductor layers 4L1 to 4L8 are isolated by a dielectric material 409. In present another embodiment, an antenna radiating element 411 comprises a signal via 401 and ground vias 402 surrounding said signal via 401 and connected to ground planes 408. In said radiating element 411 an artificial medium of a high effective relative permittivity is formed between said signal via 401 and said ground vias 402. As a distinguishing point, this artificial medium is obtained only by conductor plates 403 connected to said signal via 401. Said conductor plates 403 are separated from said ground conductor plates 408 by isolating slits 405. A radiation pad 406 is connected to one end of said signal via 401 and another end of said signal via 401 is connected to a feed pad 407. Said radiation pad 406 is separated from the ground plate 408 disposed at the conductor layer 4L1 by an isolating slit 405. Said feed pad 407 is separated from the ground plate 408 disposed at the conductor layer 4L8 by an isolated slit 410. In this embodiment of the antenna radiating element, ground vias are arranged as an ellipse. And said conductor plates 403 have also an elliptic form.

In FIG. 5 simulated data of the return loss of an antenna radiating element for which its structure is shown in FIGS. 1A-1I are presented. Transverse dimensions (limited by ground vias) of this radiating element were 5 mm by 5 mm, 8 copper conductor layers were isolated by FR-4 (Flame Retardant-4) material and the thickness of the substrate was 2 mm. As follows from obtained simulation data, developed antenna radiating element has the bandwidth of about 6 GHz taken at the return loss level of −10 dB. Thus, antenna radiating element developed is compact and broadband one.

Based on presented antenna radiating element embodiments, different types of sparse array antennas can be designed.

In FIG. 6, an arrangement of an antenna radiating element proposed is presented for a sparse array antenna. This sparse array antenna comprises nine radiating elements which can provide a near-square form in a cross-section of the radiation beam. In this arrangement the antenna radiating element 1 is disposed in the center of an imaginary square, while antenna radiating elements 2, 3, 4, and 5 are placed in its vertexes. Such arrangement gives required form of the radiation beam from the sparse array antenna. Moreover, antenna radiating elements 6, 7, 8, and 9 serve to improve the gain of the sparse array antenna. It should be noted, because each antenna radiating element in presented sparse array antenna is highly isolated, then the sidelobe level can be low.

Other Embodiments

While the present invention has been described in relation to some exemplary embodiments, it is to be understood that these exemplary embodiments are for the purpose of description by example, and not of limitation. While it will be obvious to those skilled in the art upon reading the present specification that various changes and substitutions may be easily made by equal components and art, it is obvious that such changes and substitutions lie within the true scope and spirit of the presented invention as defined by the claims.

Other Exemplary Embodiments

Some or all of the above-described embodiments can also be described as in the following further exemplary embodiments, but are not limited to the followings.

Further Exemplary Embodiment 1

An antenna radiating element disposed in a multilayer substrate comprising:

a signal via;

a plurality of ground vias surrounding said signal via;

a radiation pad connected to one end of said signal via;

a feed pad connected to another end of said signal vias; and an artificial medium disposed between said signal via and said ground vias;

wherein said multilayer substrate comprises a plurality of conductor layers isolated by a dielectric material.

Further Exemplary Embodiment 2

The antenna radiating element according to further exemplary embodiment 1 wherein said artificial medium is formed by conductor plates connected to said signal via and isolated from ground conductors by isolating slits and conductor plates connected to ground vias and isolated from said signal via by clearance holes.

Further Exemplary Embodiment 3

The antenna radiating element according to further exemplary embodiment 1 or 2 wherein said artificial medium has an effective relative permittivity variation in the direction perpendicular to the surface of said multilayer substrate.

Further Exemplary Embodiment 4

The antenna radiating element according to further exemplary embodiment 3 wherein said effective relative permittivity variation is obtained by a change of dimensions of said conductor plates connected to said signal via and disposed at different conductor layers.

Further Exemplary Embodiment 5

The antenna radiating element according to further exemplary embodiment 3 wherein said effective relative permittivity variation is obtained by a change of dimensions of said conductor plates connected to said signal via and said clearance holes disposed at different conductor layers.

Further Exemplary Embodiment 6

A sparse array antenna comprising a plurality of antenna radiating elements disposed in a multilayer substrate:

wherein said antenna radiating elements comprises:

a signal via;

a plurality of ground vias surrounding said signal via;

a radiation pad connected to one end of said signal via;

a feed pad connected to another end of said signal vias; and an artificial medium disposed between said signal via and said ground vias;

wherein said multilayer substrate comprises a plurality of conductor layers isolated by a dielectric material.

Further Exemplary Embodiment 7

A method for producing an antenna radiating element disposed in a multilayer substrate comprising:

providing a signal via;

providing a plurality of ground vias surrounding said signal via;

connecting a radiation pad to one end of said signal via;

connecting a feed pad to another end of said signal vias; and disposing an artificial medium between said signal via and said ground vias;

wherein said multilayer substrate comprises a plurality of conductor layers isolated by a dielectric material.

What is claimed is:

1. An antenna radiating element disposed in a multilayer substrate comprising:

a signal via;

a plurality of ground vias surrounding said signal via;

a radiation pad connected to one end of said signal via;

a feed pad connected to another end of said signal via; and an artificial medium disposed between said signal via and a ground via, among said plurality of ground vias;

wherein said multilayer substrate comprises a plurality of conductor layers isolated by a dielectric material.

2. The antenna radiating element according to claim 1 wherein said artificial medium is formed by conductor plates connected to said signal via and isolated from ground conductors by isolating slits and conductor plates connected to the ground via and isolated from said signal via by clearance holes.

3. The antenna radiating element according to claim 1 wherein said artificial medium has an effective relative permittivity variation in a direction perpendicular to a surface of said multilayer substrate.

4. The antenna radiating element according to claim 3 wherein said effective relative permittivity variation is obtained by a change of dimensions of conductor plates connected to said signal via and disposed at different conductor layers.

5. The antenna radiating element according to claim 3 wherein said effective relative permittivity variation is obtained by a change of dimensions of conductor plates connected to said signal via and clearance holes disposed at different conductor layers.

6. A sparse array antenna comprising a plurality of antenna radiating elements disposed in a multilayer substrate:

wherein said antenna radiating elements comprises:

a signal via;

a plurality of ground vias surrounding said signal via;

a radiation pad connected to one end of said signal via;

a feed pad connected to another end of said signal vias; and an artificial medium disposed between said signal via and a ground via, among said plurality of ground vias;

wherein said multilayer substrate comprises a plurality of conductor layers isolated by a dielectric material.

7. A method for producing an antenna radiating element disposed in a multilayer substrate comprising:

providing a signal via;

providing a plurality of ground vias surrounding said signal via;

connecting a radiation pad to one end of said signal via;

connecting a feed pad to another end of said signal vias; and disposing an artificial medium between said signal via and a ground via, among said plurality of ground vias;

wherein said multilayer substrate comprises a plurality of conductor layers isolated by a dielectric material.

8. An antenna radiating element disposed in a multilayer substrate comprising:

a signal via;

a plurality of ground vias surrounding said signal via;

a radiation pad connected to one end of said signal via;

a feed pad connected to another end of said signal vias; and an artificial medium disposed between said signal via and a ground via, among the plurality of ground vias;

wherein said multilayer substrate comprises a plurality of conductor layers isolated by a dielectric material, wherein said artificial medium has an effective relative permittivity variation in the a direction perpendicular to the a surface of said multilayer substrate, wherein said effective relative permittivity variation is obtained by a change of dimensions of conductor plates connected to said signal via and disposed at different conductor layers.

9. An antenna radiating element disposed in a multilayer substrate comprising:

a signal via;

a plurality of ground vias surrounding said signal via;

a radiation pad connected to one end of said signal via;

a feed pad connected to another end of said signal vias; and an artificial medium disposed between said signal via and a ground via, among the plurality of ground vias;

wherein said multilayer substrate comprises a plurality of conductor layers isolated by a dielectric material, wherein said artificial medium has an effective relative permittivity variation in a direction perpendicular to a surface of said multilayer substrate, wherein said effective relative permittivity variation is obtained by a change of dimensions of a conductor plates connected to said signal via and clearance holes disposed at different conductor layers.

* * * * *